United States Patent [19]

Geschka

[11] Patent Number: 4,496,925

[45] Date of Patent: Jan. 29, 1985

[54] STEPPED IRON CORE FOR STATIC OR DYNAMIC ELECTRIC MACHINES

[75] Inventor: Hugo W. Geschka, Düsseldorf, Fed. Rep. of Germany

[73] Assignee: E. Blum GmbH & Co., Valhingen, Fed. Rep. of Germany

[21] Appl. No.: 419,395

[22] Filed: Sep. 17, 1982

Related U.S. Application Data

[63] Continuation of Ser. No. 091,403, Nov. 6, 1979, abandoned.

[30] Foreign Application Priority Data

Nov. 8, 1978 [DE] Fed. Rep. of Germany ..... 2848388

[51] Int. Cl.[3] ..... H01F 17/06; H01F 27/26

[52] U.S. Cl. ..... 336/178; 336/210; 336/212; 336/216; 336/234

[58] Field of Search ..... 336/216, 217, 178, 212, 336/218, 84 M, 234, 219, 210, 100

[56] References Cited

U.S. PATENT DOCUMENTS

| | | | |
|---|---|---|---|
| 2,465,798 | 3/1949 | Granfield | 336/218 X |
| 2,476,419 | 7/1949 | Koenig | 336/178 X |
| 2,554,262 | 5/1951 | Nagel | 336/219 X |
| 2,674,721 | 2/1954 | Jackson et al. | 336/210 X |
| 2,699,532 | 1/1955 | Bussing | 336/178 X |
| 2,702,375 | 2/1955 | Johnson | 336/217 X |
| 3,341,793 | 9/1967 | Wale et al. | 336/100 X |
| 3,639,872 | 2/1972 | Hessen et al. | 336/84 M |
| 4,038,624 | 7/1977 | Namba et al. | 336/234 X |
| 4,136,322 | 1/1979 | Maezima | 336/217 X |
| 4,140,987 | 2/1979 | Maezima | 336/217 X |
| 4,214,222 | 7/1980 | La Faye | 336/84 M |

FOREIGN PATENT DOCUMENTS

| | | | |
|---|---|---|---|
| 412095 | 11/1966 | Switzerland | 336/217 |
| 20647 | of 1903 | United Kingdom | 336/210 |

*Primary Examiner*—Thomas J. Kozma
*Attorney, Agent, or Firm*—Peter K. Kontler

[57] ABSTRACT

A stepped iron core formed of sheetmetal laminations for a static or dynamic electric machine, such as a transformer, having yokes and legs and intermediate parts of at least one thereof including stacks of the sheetmetal laminations mutually held together forming individual steps of the yokes and the legs, the yoke stacks and the leg stacks being joinable with one another at respective abutment joint locations formed thereon, and means located at the respective abutment joint locations for achieving a varying magnetic reluctance therebetween so that a longer path of lines of force passes through the respective abutment joint locations in the region thereof of lower magnetic reluctance.

16 Claims, 2 Drawing Figures

STEPPED IRON CORE FOR STATIC OR DYNAMIC ELECTRIC MACHINES

Figure 1:
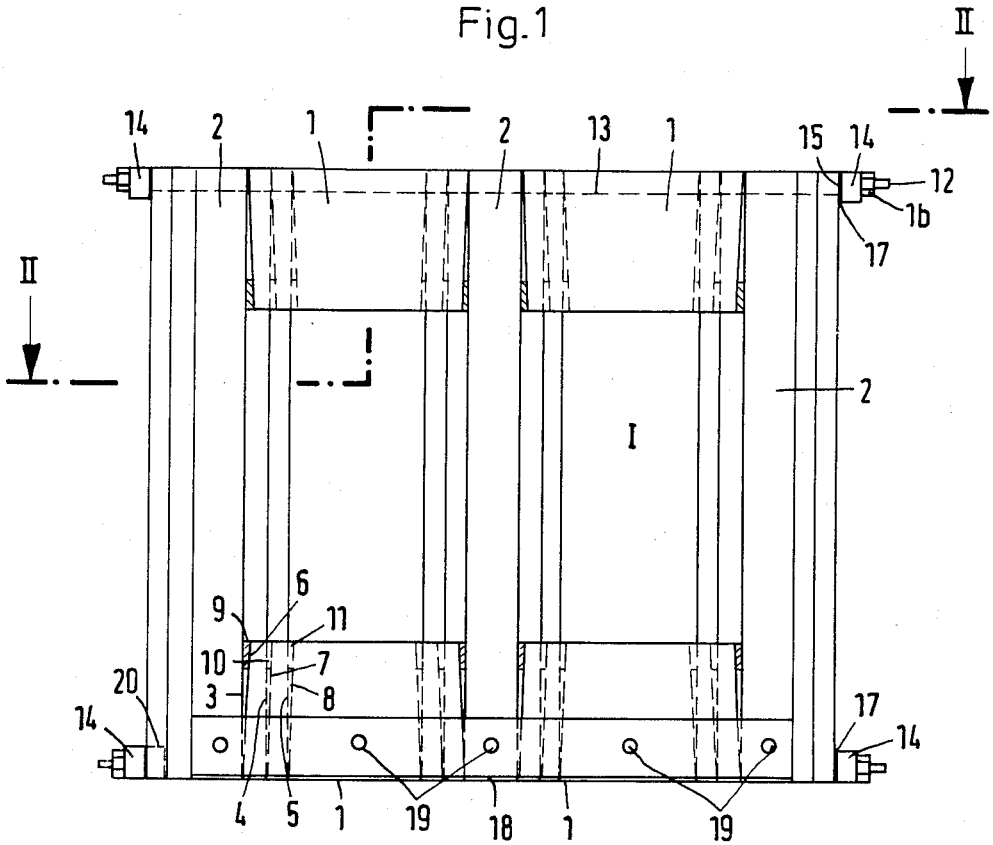

This application is a continuation, of application Ser. No. 091,403 now abandoned, filed Nov. 6, 1979.

The invention relates to a stepped iron core for static or dynamic electric machines.

From the German Pat. No. 1 240 175, an iron core for a static electric machine, namely a transformer, especially, has become known heretofore wherein the iron core is stepped i.e. has a staircase-like profile, so that, in such an application, the charging or admission factor is improved.

It is an object of the invention of the instant application to provide a stepped iron core for electric machines in a simple, advantageous and inexpensive manner yet having an improved efficiency over that for the aforementioned heretofore known stepped iron core of this general type.

With the foregoing and other objects in view, there is provided, in accordance with the invention, an iron core formed of sheetmetal laminations for a static or dynamic electric machine, such as a transformer, having yokes and legs and intermediate parts of the yokes and/or legs, having a step or staircase-like cross section, comprising stacks of the sheetmetal laminations mutually held together forming individual steps of the yokes and the legs, the yoke stacks and the leg stacks being joinable one with the other at respective abutment and joint locations formed thereon, and means located at the respective abutment and joint locations for achieving a varying magnetic reluctance therebetween so that a longer path of lines of force passes through the respective abutment and joint locations in the region thereof of lower magnetic reluctance.

The individual sheetmetal laminations of the laminated stacks are held together, for example, by cement or adhesive. Such laminated stacks can be prefabricated in an especially simple and economical manner and can also be joined together in an especially simple and time-saving manner. The varying magnetic reluctance provided between the abutment and joint locations ensures the formation of a magnetic core closed in itself in every step and in every step stack, respectively, whereby uniform distribution of the magnetic lines of force over the abutment location of each step is assured. In accordance with another feature of the invention, this varying magnetic reluctance is achievable by providing a varying spacing between the respective abutment and joint locations, respectively, of the individual steps. An especially uniform distribution of the lines of force, which also ensures optimal use of the available iron cross sections, can be attained in accordance with the invention when, within each step, the product of the reluctance, formed, for example, by the varying spacing between the respective abutment and joint locations, and the length of the flux of the lines of force is at least approximately equal.

In accordance with a further feature of the invention, the spacing is in the form of an angle defined between the abutment and joint locations of the respective step stacks, the angle subtending from 1 to 6 minutes of arc.

In accordance with an added feature of the invention, the electric machine includes an intermediate layer, such as a foil strip, disposed between the abutment and joint locations of the respective step stacks, which serves for securing the air gap or maintaining the spacing therebetween. Advantageously, the strip of foil which is used is formed of nonmagnetic or weakly magnetic material.

In accordance with another feature of the invention, each step of the iron core, in addition to forming a magnetic circuit, also forms a mechanical or structural unit, the individual sheetmetal laminations of the respective step stack being disposed in planes extending parallel to one another and, furthermore, means are provided defining elongated recesses extending parallel to the sheetmetal laminations, as well as clamping means receivable in the recesses. The mechanical connection of the respective steps of the iron core into units is effected by the clamping means, such as screw bolts. The elongated recesses in which the screw bolts are received are channel or tunnel-shaped.

The elongated recesses may be formed by drilling or boring; however, in accordance with an additional feature of the invention, the recesses are formed free of any burr or chips. To form them in this manner, in accordance with yet another feature of the invention, the means defining the elongated recesses comprise the edges of a plurality of the sheetmetal laminations joined together at varying heights. Further in accordance with the invention, sheetmetal laminations of smaller height are disposed between sheetmetal laminations of greater height to form the elongated recesses. In this connection and in accordance with another feature of the invention, the elongated recesses are located in regions less loaded by the magnetic lines of force.

In accordance with yet a further feature of the invention, the sheetmetal laminations of the respective step stacks have varying permeability.

To improve the mechanical adhesion of the respective step stacks, in addition to the clamping means provided for holding the stacks of the respective steps together, the clamping means including a clamping part such as a nut, there is provided, in accordance with the invention, a clamping element located, for example, between the screw head or nut and an outer contour of the step stack, especially the outer sides of the legs of the individual steps. This clamping element may be a clamping strip or plate in order to exert clamping pressure uniformly onto the individual sheetmetal laminations and the abutment and joint locations. For this purpose and, in accordance with yet an added feature of the invention, the clamping surfaces i.e. the outer contours, of the respective step stacks on which the clamping elements are seatable, are planar i.e. have been leveled or planarized, for example, by a grinding operation. It is also advantageous, in this regard, to remove by a treatment, such as a chemical treatment, the connections, such as grinding burr, that may have been formed during the material removal, from between the sheetmetal laminations.

In accordance with yet another feature of the invention, however, the step stacks may be formed with recesses defined by clamping surfaces corresponding to those of the clamping elements.

In accordance with yet a further feature of the invention, separate or foreign material, for example, insulating foil, is disposed between the clamping surfaces and the clamping elements to avoid magnetic short circuits.

In accordance with yet an additional feature of the invention, the invention applies to a transformer of step-type construction having steps of yokes and legs formed of stacks of sheetmetal laminations which are held together, and the respective yoke and leg stacks mutually abut at abutment and joint locations formed thereon, means located at the respective abutment and joint locations for achieving a varying magnetic reluctance therebetween so that longer paths of lines of force extend through the respective abutment and joint locations in the region thereof of lower magnetic reluctance; the stacks of the individual steps being clamped together by mechanical means, a closed magnetic core within a mechanical structural unit being formed within each step, and the steps of the iron core being held together, for example, by clamping bars provided on both sides of the yokes.

Other features which are considered as characteristic for the invention are set forth in the appended claims.

Although the invention is illustrated and described herein as embodied in a stepped iron core formed of sheetmetal laminations for static or dynamic electric machines such as transformers, it is nevertheless not intended to be limited to the details shown, since various modifications and structural changes may be made therein without departing from the spirit of the invention and within the scope and range of equivalents of the claims.

Figure 2:
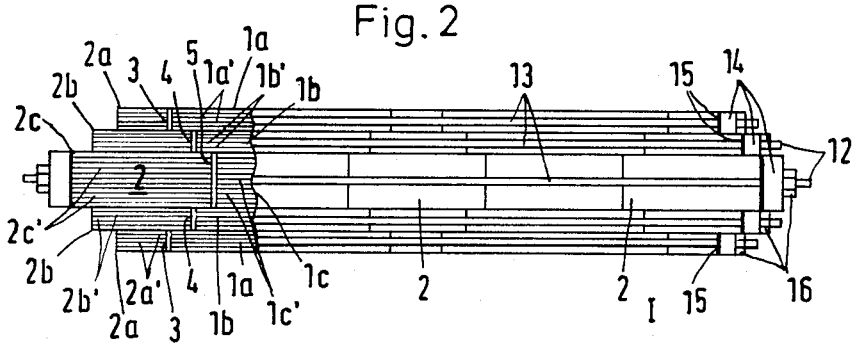

The construction and method of operation of the invention, however, together with additional objects and advantages thereof will be best understood from the following description of specific embodiments when read in connection with the accompanying drawings, in which:

FIG. 1 is a top plan view of an inner core constructed in accordance with the invention; and FIG. 2 is a cross-sectional view of FIG. 1 taken along the line II—II in direction of the arrows.

Referring now to the features of the drawing, there is shown therein an iron core I for an electric machine, namely a transformer in the illustrated embodiment, which is formed of yokes 1 and legs 2 as well as coils which have not been illustrated in the interest of clarity. As viewed in the cross-sectional view of FIG. 2, it is readily apparent that the legs 2 are constructed in a stepwise or staircase manner, and the intermediate yokes 1 abut, with similarly shaped regions, against the correspondingly constructed steps or stairs of the legs 2.

The individual steps of the legs 2 are assembled from lamination stacks 2*a*, 2*b* and 2*c*, the individual sheetmetal laminations 2*a*′,2*b*′ and 2*c*′ of the respective stacks 2*a*, 2*b* and 2*c* being held together, for example, adhesively.

In a similar manner, the sheetmetal laminations 1*a*′, 1*b*′ and 1*c*′ of the lamination stacks 1*a*, 1*b* and 1*c* are held together, for example, also by adhesive or cement.

The individual yoke and leg stacks and intermediate partial yoke and/or leg stacks are disposed opposite one another at abutment or joint locations. This structural detail or feature is shown in the illustrated embodiment only at the abutment region of the legs and the intermediate yoke parts at the lower left-hand side of FIG. 1. The abutment locations or joints 3, 4 and 5 at the leg stacks 2*a*, 2*b* and 2*c* lie opposite the abutment locations or joints 6, 7 and 8 of the yoke stacks 1*a*, 1*b* and 1*c*, respectively, the spacing between the respective abutting stacks varying in such a manner that the smallest spacing therebetween i.e. near the vertex of the angle defined between the abutment locations 3 and 6, for example, exists in the region through which the longer paths of lines of force extend, whereas the largest spacing therebetween i.e at the opposite end of the angle from the vertex, exists in the region through which the shorter paths of the lines of force extend. To maintain this varying spacing, respective foils 9, 10 and 11 are suitably inserted between the mutually opposing abutment locations 3, 6; 4, 7 and 5, 8, respectively.

The abutment locations per se are planar, for example, by grinding, and the grinding burr which may form is subsequently removed, for example, mechanically or chemically, especially by etching.

The individual steps formed from the stacks 2*a*–1*a*, 2*b*–1*b* and 2*c*–1*c* form in themselves a closed magnetic core and, after the core has also been provided with suitable coils, are held together by clamping means formed as threaded rods 12.U or channel-shaped recesses 13 are provided in the less magnetically loaded region of both the leg stacks 2*a*, 2*b* and 2*c* as well as of the yoke stacks 1*a*, 1*b* and 1*c*. These recesses 13 are formed simply by providing sheetmetal laminations of suitably smaller height between sheetmetal laminations of greater height.

To obtain uniform contact pressure and to prevent shifting of the individual sheetmetal laminations relative to one another, clamping elements in the form of clamping blocks 14 are placed between the clamping surfaces 15 of the leg stacks 2*a*, 2*b* and 2*c*, respectively, amid the respective nuts 16 threaded onto the threaded rods 12. The clamping surfaces 15 are advantageously also planar and are freed of any mechanical connections resulting from burr possibly formed during a grinding operation, the mechanical connections being removed, for example, by etching, lapping, sandblasting or the like.

Both the individual laminations of each of the respective stacks may differ in permeability from one another, as well as the laminations of each of the respective stacks may differ in permeability from those of others of the stacks.

In the same manner as was provided between the abutment locations of the individual yoke and leg part or intermediate parts, as hereinaforementioned, intermediate layers or spacers 17 of magnetically nonconductive material may be provided between the clamping surface 15 and the clamping elements 14, respectively, to preclude the occurrence of magnetic short circuits.

The transformer according to the invention can be assembled or held together in the form of a compact unit by means of a bar or rail extending on both sides of the yoke or by means of a beam 18 and suitably provided through-bolts 19.

It is quite evident that the iron core according to the invention is capable of being produced and assembled in an especially simple and easy manner and that, furthermore, within the individual steps which, in themselves, form a closed magnetic circuit, the greater spacing between the respective opposing abutment locations exists in the region wherein the shorter paths of force lines are formed.

The core or the leg core parts could also, however, be constructed so that they have a recess 20 formed therein (as shown at the lower lefthand side of FIG. 1) wherein the clamping elements are receivable.

I claim:

1. A stepped iron core for a static or dynamic electric machine, such as a transformer, comprising yokes and legs each including stacks of coherent sheet metal laminations and each such stack constituting a portion of a discrete step of the core, the yoke stacks and the leg stacks of each of said steps forming abutment joints and the joints of neighboring steps being staggered with reference to one another, each of said steps providing longer and shorter paths for magnetic force lines; a plurality of clamping means, at least one for each of said steps, for holding together the yoke and leg stacks of the respective steps, each of said clamping means comprising a clamping part and a clamping element disposed between an outer contour of a stack in the respective step and the associated clamping part; and means for achieving a varying magnetic reluctance between the stacks which form said joints so that said longer paths for magnetic force lines extend through the respective joints in the lower magnetic reluctance regions thereof.

2. The core of claim 1, wherein said means for achieving a varying magnetic reluctance includes means for establishing a varying spacing between the stacks which form said joints.

3. The core of claim 2, wherein said means for establishing said varying spacing includes intermediate layers between the stacks defining said joints.

4. The core of claim 3, wherein said intermediate layers include foil strips.

5. The core of claim 2, wherein said varying spacing is in the form of angles defined by the stacks which form said joints, each of said angles subtending an arc of between 1 and 6 minutes.

6. The core of claim 1 wherein, within each of said steps, the product of reluctance and the length of magnetic force lines is at least substantially equal.

7. The core of claim 1, wherein the laminations of each of said stacks are disposed in parallel planes and said stacks define recesses for portions of the respective clamping means.

8. The core of claim 7, wherein said recesses are flanked by surfaces which are devoid of burrs.

9. The core of claim 7, wherein the laminations of said stacks have edges bounding the respective recesses.

10. The core of claim 9, wherein the laminations whose edges bound said recesses have different heights.

11. The core of claim 7, wherein said steps include first and second portions which are respectively traversed by greater and lesser numbers of magnetic force lines and said recesses are disposed in the second portions of the respective steps.

12. The core of claim 1, wherein the laminations of at least some of said stacks have different permeabilities.

13. The core of claim 1, wherein said outer contours have planar surfaces providing seats for the respective clamping elements.

14. The core of claim 1, wherein at least one stack of said steps has a recess for the respective clamping element.

15. The core of claim 1, wherein said outer contour of each of said steps includes a clamping surface and further comprising a body of separate material interposed between each such clamping surface and the respective clamping element.

16. The core of claim 15, wherein said separate material is an insulating foil.

* * * * *